US005702200A

United States Patent [19]

Hawkins

[11] Patent Number: 5,702,200

[45] Date of Patent: Dec. 30, 1997

[54] MANHOLE COVER FRAMES

[75] Inventor: David John Drake Hawkins, Claremont, South Africa

[73] Assignee: CSR Limited, Sydney, Australia

[21] Appl. No.: 646,474

[22] Filed: May 8, 1996

Related U.S. Application Data

[62] Division of Ser. No. 307,310, Sep. 16, 1994, Pat. No. 5,549,411.

[30] Foreign Application Priority Data

Sep. 24, 1993 [ZA] South Africa ..... 93/7067
Aug. 23, 1994 [AU] Australia ..... PM7622

[51] Int. Cl.[6] ..... E02D 29/14

[52] U.S. Cl. ..... 404/25; 404/26

[58] Field of Search ..... 404/25, 26; 52/19, 52/20; 210/164, 166

[56] References Cited

U.S. PATENT DOCUMENTS 4,553,874 11/1985 Thomann et al. ..... 210/164 X
4,592,674 6/1986 Baliva ..... 404/25
4,759,656 7/1988 Wilson ..... 52/20 X

FOREIGN PATENT DOCUMENTS 2824097 9/1979 Germany .
114257 6/1945 Sweden ..... 210/164

OTHER PUBLICATIONS

"Rattlefree and Basily Shimmed", Engineering News--Record, Dec. 12, 1957, p. 82.

*Primary Examiner*—James Lisehora
*Attorney, Agent, or Firm*—Abelman, Frayne & Schwab

[57] ABSTRACT

A spacer arrangement is provided for use in raising the height of a manhole cover frame, including one or more base spacer elements and one or more upper side extension elements; said one or more base spacer elements are adapted to be located within said manhole cover frame with said one or more side extension elements extending upwardly relative thereto; the spacer arrangement is adapted to receive a manhole cover; at least an underside surface of said one or more base spacer elements includes downwardly directed projections for stabilising at least said one or more base spacer elements.

4 Claims, 3 Drawing Sheets

FIG. 3
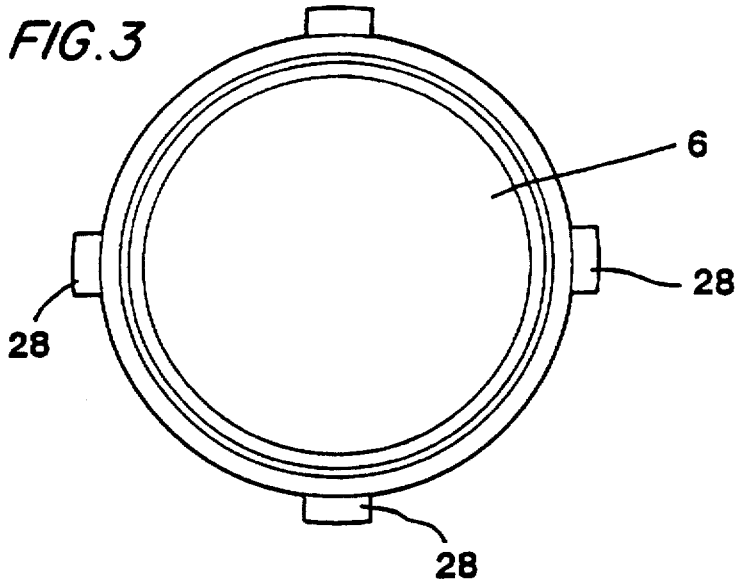
FIG. 4
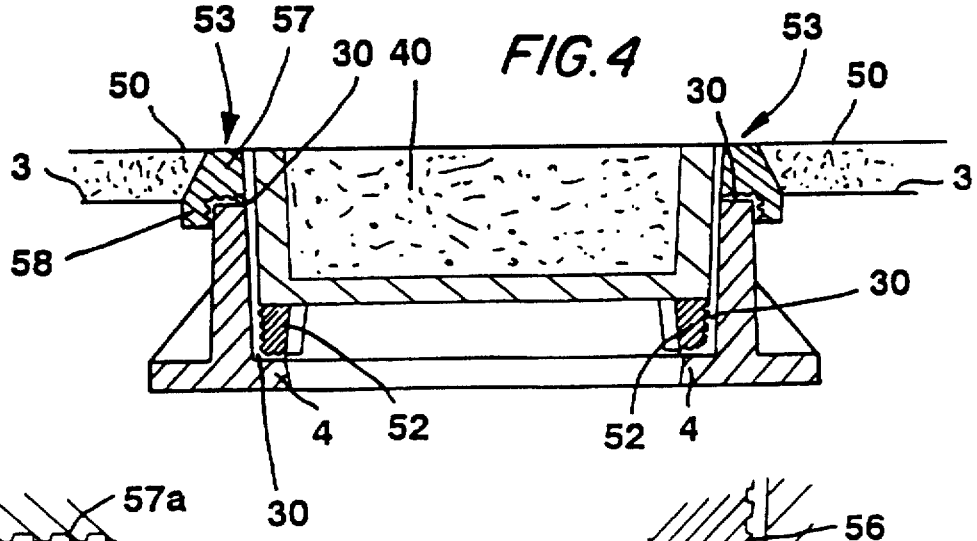
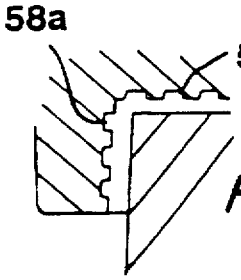
FIG. 4A
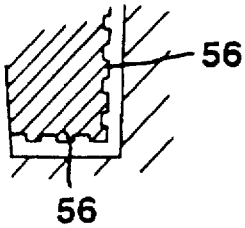
FIG. 4B

MANHOLE COVER FRAMES

This is division of application Ser. No. 08/307,310 filed Sep. 16, 1994, now U.S. Pat. No. 5,549,411.

THIS INVENTION relates to manhole cover frames and in particular to an improved arrangement and method for use in raising the height of manhole cover frames to accommodate manhole covers relative to varying heights of related surface(s), such as related road and/or pavement surfaces.

BACKGROUND TO THE PRESENT INVENTION

It is well-known to provide manholes, such as for example in road and pavement surfaces, for providing access to underground services and installations. For example, for the purpose of providing access to underground electrical, telephone, plumbing and sewerage services and installations. These are by way of example only. Such manholes include frames which are normally set in concrete or some other settable material, and are positioned substantially flush with a road or pavement surface. Covers are provided for such frames and fit within the open upper end of said frames so as to again be substantially flush with the road or pavement surface.

It will be appreciated however, that in the case of many road or pavement surfaces, resurfacing is required from time to time. For example, typically a city road may be resurfaced by applying a Further layer of surface material on top of an existing surface material. For example, by applying a 40 mm thick layer of surface material on top of an existing surface.

It will therefore be appreciated that when such an existing surface is resurfaced, the upper surface of the road or pavement will be above the upper surface of the original or existing manhole frame and cover. Clearly, this is unacceptable, and it is therefore necessary to provide an arrangement and method whereby the manhole cover frame and cover can be raised above the original height thereof, so as to be substantially flush or normal with the upper surface of the new or resurfaced layer of surface material.

Up until this time, manhole cover frames have often been raised by digging the frame out of its concrete setting, and lifting it to the appropriate level and resetting it in concrete relative to the new raised surface of the road or pavement. This has however been found to be inefficient, time consuming and expensive. Other arrangements and methods have also been proposed, but these have been generally found to be unsatisfactory and inefficient.

The present invention sets out to provide an arrangement and method for use in raising the height of manhole cover frames, relative to a new surface of for example a road or pavement, which go at least some way towards overcoming or minimising the problems and disadvantages with such arrangements and methods known and used up until this time.

Other objects of this invention will become apparent from the following description.

BRIEF SUMMARY OF THE PRESENT INVENTION

According to one aspect of this invention, there is provided an arrangement for use in raising the height of a manhole cover frame, including one or more base spacer elements and one or more side extension elements; said one or more base spacer elements being adapted to be located within said manhole cover frame with said one or more side extension elements extending upwardly relative thereto, said arrangement being adapted so as to receive and locate a manhole cover; at least an underside surface of said one or more base spacer elements including downwardly directed projections for stabilising location of at least said one or more base spacer elements.

According to a further aspect of this invention, there is provided a manhole cover frame including one or more base collar elements adapted to be received and located within a mouth of a manhole cover frame and further including one or more separate cap elements adapted to be located and seated on an upper rim of said manhole cover frame spaced apart from and above said one or more collar elements; said one or more cap elements having a main body portion extending upwardly from the upper rim of said manhole cover frame and having a rear downwardly extending lip which engages about an outer surface of said upper rim of said manhole cover frame.

According to a further aspect of this invention, there is provided a spacer arrangement for a manhole cover frame including a substantially annular first collar element adapted to be received and located within a mouth of a manhole cover frame and having downwardly directed and spaced apart projections on an underside thereof, a separate and an annular cap element being provided and adapted to be engaged with and seated on an upper annular rim of said manhole cover frame; said cap element having a main body portion seated on said upper rim with an outer and downwardly extending lip that engages over an outer surface of the outer rim of said manhole cover frame; at least a lower surface of said main body portion of said cap being provided with a plurality of spaced apart downwardly extending projections.

According to a further aspect of this invention, there is provided a spacer arrangement for a substantially rectilinear manhole cover frame, wherein manhole cover support steps are provided within said frame at or adjacent corners thereof, one or more spacer elements being provided in association with each corner support step; a rectilinear cap being provided and having a main body portion adapted to be seated on upper rims of said manhole cover frame and including an outwardly and downwardly extending lip portion which engages with and about outer surfaces of said frame.

According to a further aspect of this invention, there is provided a spacer arrangement for use in raising the height of an existing manhole cover frame, including a substantially annular base spacer collar, having a side extension element extending upwardly substantially circumferentially therefrom; said spacer arrangement being adapted to be located within a mouth of an existing manhole cover frame, such that an underside of said collar is seated on an upper surface of an annular step provided within the mouth of said existing manhole cover frame; said side extension element extending upwardly and outwardly from said collar so that an upper portion thereof, is seated on an upper rim of said existing manhole cover frame; projections extending downwardly from an underside of said base spacer collar for stabilising location of said collar on and relative to said step; projections extending outwardly from one or more outer surfaces of said side extension element, and wherein grout is provided between adjacent respective surfaces of said spacer arrangement and said existing manhole cover frame.

BRIEF DESCRIPTION OF THE ACCOMPANYING DRAWINGS

This invention will now be described by way of example only and with reference to the accompanying drawings, wherein.

Figure 2:
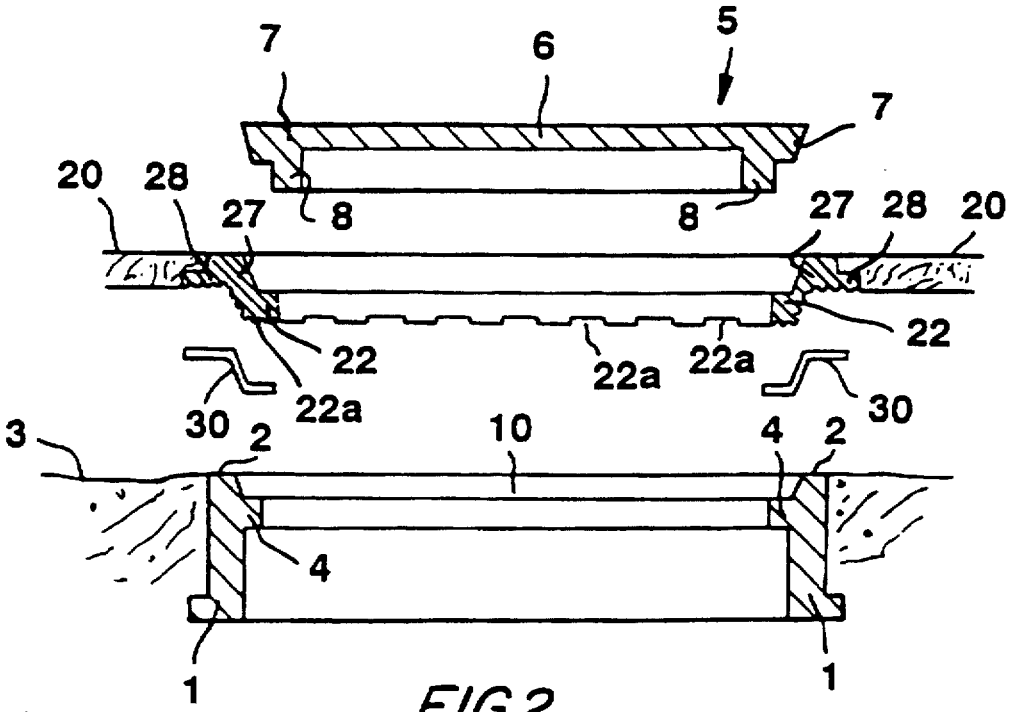
FIG. 2 is a sectional view of a manhole cover frame with a spacer arrangement according to one form of the present invention.
Figure 2A:
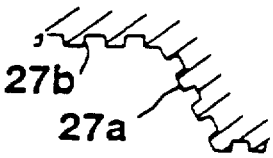

FIG. 2*a* is an enlarged view of a portion of the spacer arrangement shown in FIG. 2 of the drawings.

FIG. 3 is a plan view of the arrangement shown in FIG. 2 of the accompanying drawings.

FIG. 4 is a sectional view of a manhole cover frame including a spacing arrangement according to a further form of the present invention.

FIG. 4*a* is an enlarged view of a first portion of the spacer arrangement shown in FIG. 4 of the drawings.

FIG. 4*b* is an enlarged view of a second portion of the spacer arrangement shown in FIG. 4 of the drawings.

Figure 5:
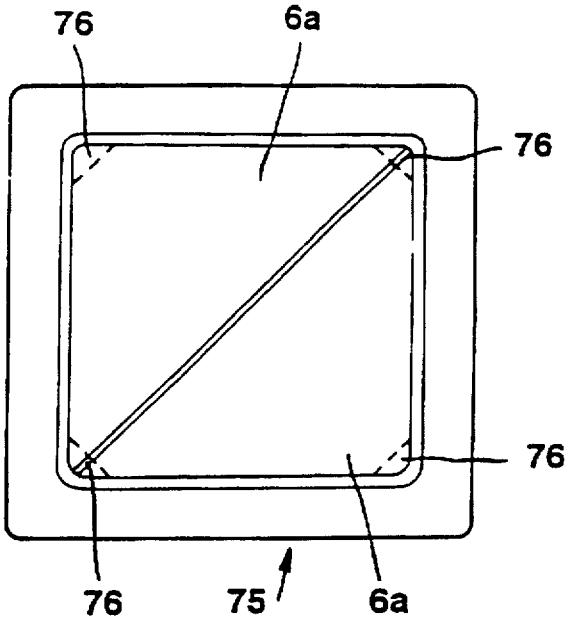

FIG. 5 is a plan view of a rectilinear manhole cover frame according to one form of the present invention.

Figure 5A:
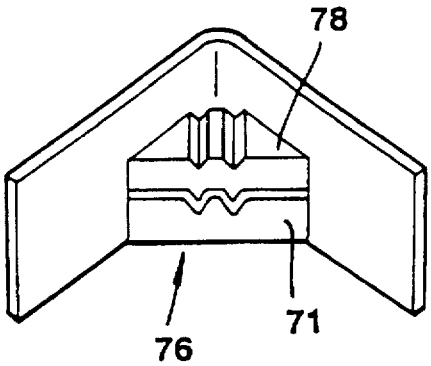

FIG. 5*a* is a sectional view of a corner of the frame shown in FIG. 5 of the drawings.

Figure 6:
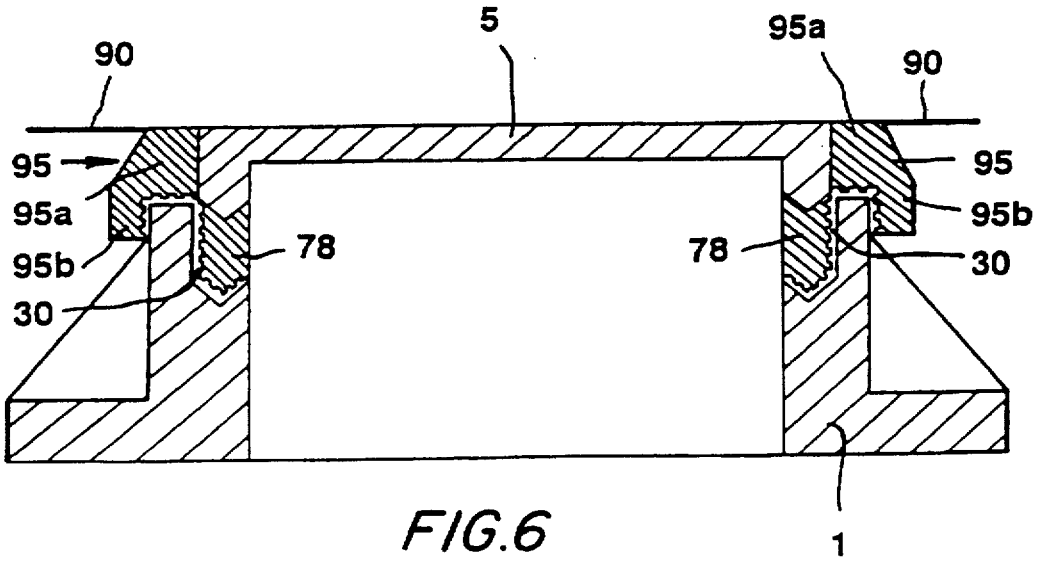

FIG. 6 is a sectional view of the further arrangement of the invention as shown in FIG. 5 of the accompanying drawings.

DETAILED DESCRIPTION OF PREFERRED EMBODIMENTS OF THE INVENTION

The invention will now be described by way of example only with reference to the accompanying drawings. It should be appreciated however that modifications and improvements may be made to the invention without departing from the scope or spirit thereof.

In forms of the invention described herein by way of example, the manhole cover frame and arrangement for allowing for the height thereof to be raised relative to a road or pavement surface may preferably be constructed of an appropriate cast metal material, although this is by way of example only. Other materials can be used to advantage.

Figure 1:
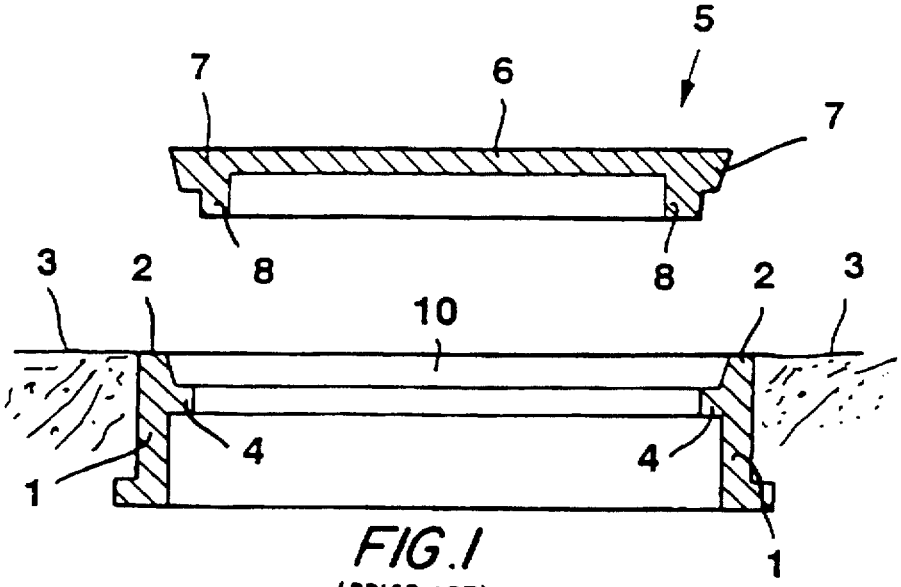
FIG.1 (PRIOR ART)
FIG. 1 is a side sectional drawing of a manhole cover frame and manhole cover as used up until this time.

Referring to FIG. 1 of the accompanying drawings, this shows an arrangement used up until this time. Thus, a manhole cover frame 1 is shown as being recessed into the ground surface, and being held in position such as by concrete or some other settable material. The upper side edges 2 of the manhole cover frame 1 are substantially flush with a road or pavement surface 3 as shown in the accompanying drawings. Inwardly of the upper mouth of the manhole cover frame 1, there is an inwardly extending step or flange portion 4, which in the case of a substantially arcuate or circular manhole cover, is a substantially arcuate step or flange 4. The manhole cover 5 is provided, having a main body portion 6 with outwardly extending sides 7, and an inwardly recessed neck 8. To place the manhole cover in place, the manhole cover 5 is placed within the open mouth 10 of the manhole cover 1 and the undersides of the outwardly extending side portions 7 sit or rest on the upper surfaces of the step 4. As will be appreciated, problems arise when it is desired to raise the level of the existing surface 3. If such a surface 3 is raised, without action being taken to raise the height of the manhole cover frame 1 and manhole cover 5, then clearly the manhole cover frame 1 and manhole cover 5 will be below the upper surface of any resurfaced layer.

Referring therefore to FIGS. 2 and 3 of the accompanying drawings, these show a spacer arrangement according to one form of the present invention.

Thus, if it is desired to raise the surface 3 for example to the level 20 shown in FIG. 2 of the accompanying drawings, an appropriate spacer arrangement according to the present invention is used. Such a spacer arrangement includes a base element 22 in the form of a substantially annular base collar, which extends upwardly at the outer annular surface thereof, into a circumferentially extending side element 27 which extends upwardly therefrom. Preferably, the inner sides thereof are tapered so as to allow for a "snug" fit of the manhole cover 5. The annular base 22 and circumferentially extending side element 27 are preferably integrally formed one with the other. If desired outer surfaces of the side element 27 can be provided with radially extending lugs or extension elements 28, which will be embedded in the new surface material. The location of the spacer arrangement in the form of the integrally formed collar 22 and side extension element 27, can therefore raise the height of the manhole cover frame 1 and allow for the location of the cover 5 in a position above the original surface 3 and substantially flush with the upper surface 20 of the resurfaced area, by the collar 22 being seated on the step 4 of the existing manhole frame and the side extension element 27 extending upwardly therefrom. In a preferred form of the invention, upper portions of the element 27 sit on an upper rim 2 of the side of an existing manhole cover frame. The manhole cover 5 is therefore seated on the upper surface of the collar 22 within the area defined by the collar 22 and side extension element 27.

In order to bring about a secure location of the collar 22 within the manhole cover frame 1, and to allow for secure location relative to the surfaces of the step 4, an underside surface of the collar 22 can be provided with castellations or protrusions 22*a*, spaced apart one from the other, such as downwardly and axially extending protrusions, which will allow for stability in locating the collar 22 within the mouth 10 of the existing manhole cover frame 1 and on and relative to the upper surfaces of the step 4.

If desired, outer annular side surfaces of the collar 22 and outer surfaces of the side element 27, can also be provided with protrusions or castellations 27*a*, 27*b*, as shown in the accompanying drawings.

Further, in order to bring about an effective location and seal between the spacer arrangement and the existing manhole cover frame 1, a settable material such as grout 30 is applied between one or more adjacent surfaces. For example, the grout 30 can be provided between upper surfaces of the step 4 and the lower surfaces of the collar 22, the spaced apart projections 22*a* allowing for the grout to flow therethrough. If desired, the settable material 30 can also be provided between side surfaces of the existing manhole cover frame 1 and for example the underside surfaces of the side portions 27 and adjacent surfaces of the existing manhole cover frame 1, all of which will be adjacent, or come into contact one with the other on location of the spacer arrangement within the mouth 10 of the existing manhole cover frame 1. If desired therefore, one or more surfaces of the spacer arrangement which will come into contact with surfaces of the existing manhole cover frame 1, can be provided with protrusions or castellations and can have grout 30 applied therebetween. As indicated, this allows for a positive location. The castellations or protrusions 22*a*, 27*a*, 27*b* extending from surfaces of the spacer arrangement, allow for positive location and stability relative to the existing manhole cover frame 1. They also provided channels therebetween, and through which grout 30 can flow for the purpose of maintaining stability, and a positive connection.

While the invention is described by way of example only to the use of grout, any other settable material can be used.

In one preferred form of the invention however, an epoxy grout is used. This is however by way of example only.

In the preferred form of the invention, the base collar 22 and upwardly extending side element 27 are integrally formed one with the other, in a single annular unit. If desired however, the unit can be formed in a plurality of sections, such as a plurality of semi-circular or annular sections which are butted and secured/held together in use. For example, they can be bonded together or held together by clips bolts, welding and the like. This brings about certain advantages in so far as economies of scale in manufacture are concerned, and also allows for ease of handling. This is however by way of example only.

Referring now to FIG. 4 of the accompanying drawings, this shows a further form of the invention where for example, the manhole cover 1 may be deeper than the extension allowed for, by (for example) the use of the arrangement shown with reference to FIGS. 2 and 3 of the accompanying drawings. In other words, and with reference to FIG. 4 of the drawings, the cover 40 would be deeper than the thickness of the new road surface 50. In such circumstances, the arrangement shown in FIG. 4 of the accompanying drawings can be utilised, and wherein the base spacer collar, and side extension element are separate integers.

Referring therefore to FIG. 4 of the accompanying drawings, it will be seen that the existing manhole cover frame 1 is located in position relative to the existing road level 3 which is shown in the drawings. In order to allow for the location of the manhole cover in a manner such that the top thereof will be substantially flush with the level of the new road or path surface 50, a base spacer element or collar 52 is located on the inwardly extending step or flange 4 of the existing manhole cover frame 1 and a separate and upwardly extending side element 53 is located at the upper end of the existing frame 1. In this form of the invention, the upwardly extending side element 53 is in the form of a separate cap, as shown in FIG. 4 of the drawings. In the form of the invention shown with reference to FIG. 4 of the accompanying drawings, the manhole cover frame 1 and cover 5 are substantially annular, and in the first instance a base collar 52 being an annular collar is inserted into the existing manhole cover frame to be located on the upper surface of the inwardly extending annular flange or step 4 of the existing manhole cover frame 1. If desired, a plurality of such collars or spacer elements 52 can be provided one on top of the other, although in the form of the present invention shown by way of example only with reference to FIG. 4 of the drawings, a single collar 52 of a predetermined or desired height or depth is provided. Preferably, this is provided with castellations or protrusions 56 on at least a lower side thereof, and if desired on lower and outer sides, of the collar 52, so that they extend downwardly and substantially radially, and so as to abutt against adjacent surfaces of the existing manhole cover frame 1. As described with reference to earlier forms of the invention, if desired, grout 30 can be provided between one or more of said adjacent surfaces. The manhole cover 40 is then able to be seated on upper surfaces of the collar 52, but in that it will extend above upper ends of the existing manhole cover frame 1, a side extension element is provided in the form of an upper cap 53 which includes a main body portion 57 extending upwardly from both the upper side ends of the existing frame 1 and from and relative to the base collar element 52. The main body portion 57 therefore extends upwardly and is angled outwardly and downwardly at the rear side thereof, so as to extend into a downwardly extending lip 58, which extends over the outer surface of the side wall of the existing manhole cover frame, so as to positively locate the cap 53 in position and prevent radial movement or dislocation.

In preferred forms of the invention, a suitable settable material such as grout 30 is located between adjacent surfaces of the existing manhole cover frame 1 and the underside of the body portion 57 and inner surface of the lip 58, to effect a secure seal therebetween. If desired, one or more of the underside of the body portion 57 or inner surface of the lip portion 58, can be provided with axial protrusions or castellations **57*a*, 58*a*, for enhancing stability and allowing for the flow of grout 30 therethrough. Once the cap 53 is located in position, it will provide an extended or raised manhole cover frame and allow for the new road level 50 to be built up to a position substantially flush therewith and flush with the upper surface of the manhole cover 40 (when in position). By way of example, in FIG. 4 of the accompanying drawings, an alternative form of manhole cover 40 is shown which is a substantially flattened "U" shaped housing, which is filled with an appropriate roading material or the like, to the upper level thereof, to be flush with the new road level 50**. In the other forms, any other form of manhole cover can however be used.

It will be appreciated however that the form of the invention shown in FIG. 4 of the accompanying drawings allows for the accommodation of varying sizes and depths of manhole cover, in a straightforward and efficient manner.

Turning now to FIGS. 5, **5*a* and 6 of the accompanying drawings, these drawings show a further form of the invention where the manhole cover frame 75 and manhole cover 6** are substantially rectilinear, as compared with the usual and more frequent annular configuration.

In certain countries, where such substantially rectilinear manhole cover frames are used, the covers 5 are formed of a rectilinear formation also, or can for example be divided into two substantially triangular segments **5*a*, which are clipped or otherwise secured one to the other. However, in order to locate the covers within the square manhole cover frames, the manhole cover frames must be provided with appropriate bearing points or steps. Preferably therefore, these are provided at the points of the triangle(s) 76, of the cover 5**, in order to avoid as far as possible, the rocking of the cover.

Problems arise however, in that in certain countries (such as for example the United Kingdom), standard specifications require a minimum clearance opening in manhole cover frames. Thus, when it is not possible to provide a step around the complete inner surface of the frame, steps for mounting the corner edges of the covers are, for example, provided in each corner 76 of the rectilinear frame. This is shown by way of example only in FIG. **5*a* of the drawings, wherein each corner 76 includes a support step 71. In normal use, the cover will be mounted on such support steps 71 in the manner such as to bring the upper surfaces 6*a* of the cover 5** are substantially flush with the upper surface of the frame and the road surface.

When it is desired to raise the frame and surface of the cover frame (such as to accommodate the raising of the surface of a road or footpath), comer spacer elements 78 are provided and are located in each corner 76 of the rectilinear frame 75, above each comer step 71. These can be secured in position such as by grout 30 and the like. Further, they can be provided with an irregular upper surface, such as a grooved surface, for positive location. If desired, lower and/or outer surfaces of the comer spacer elements 78 can be provided with protrusions or can be profiled so as to positively engage within a substantially corresponding profile on upper surfaces of the corner steps 71. This will then allow for the engagement of the cover 5 relative thereto, such as to raise the frame and cover 5 to a predetermined or desired level corresponding substantially to a level 90, of the new road or footpath surface. As in other forms of the invention, grout 30 can be provided between adjacent surfaces of the spacer step and step and adjacent side walls of the existing manhole cover frame.

In order to raise the sides of the manhole cover frame 1 to the desired position (such as shown in FIG. 6 of the drawings), cap means 95 can be provided including a main body portion 95*a* and a downwardly extending rear lip, 95*b* which fits over the outer sides of the existing frame member 1 in the manner generally described with reference to the other forms of the invention (for example with reference to FIG. 4 of the drawings, referring to a substantially annular arrangement). Again, as with other forms of the invention, lower and inner surfaces of the cap member 95 can be provided with castellations or protrusions, and grout 30 can be used to assist in the location and bonding of the integers one with the other.

It should be appreciated that this invention has been described by way of example only and that modifications and improvements may be made to the invention without departing from the scope thereof as defined by the appended claims.

I claim:

1. A spacer arrangement for a manhole cover frame, said manhole cover frame having substantially straight line edges, said manhole cover frame having corners at an intersection of each adjacent pair of said edges, said manhole cover frame being provided with manhole cover support steps at or adjacent said corners, said manhole cover frame having an upper side rim and an outer surface, said manhole cover frame being adapted to support a manhole cover, said spacer arrangement comprising:

at least one spacer element adapted to rest on each of said manhole cover support steps and adapted to support said manhole cover, and a cap with substantially straight line edges having a main body portion adapted to be seated on said upper side rim of said manhole cover frame and including an outwardly and downwardly extending lip portion which engages with and about said outer surface of said manhole cover frame, said main body portion having a top surface when seated on said upper side rim of said manhole cover frame, said manhole cover fitting within said cap, said manhole cover having a top surface when placed within said cap, when resting on said at least one spacer element, when said main body portion of said cap is seated on said upper side rim of said manhole cover frame, and when said at least one spacer element rests on each of said manhole cover support steps, said top surface of said manhole cover being substantially level with said top surface of said main body portion.

2. A spacer arrangement as claimed in claim 1, wherein each of said manhole cover support steps are provided with at least one recess and/or projection an at least an underside surface of said at least one spacer element is provided with at least one projection to engage with said at least one recess and/or projection in each of said manhole cover support steps.

3. A spacer arrangement as claimed in claim 1, wherein at least one surface of said cap is provided with at least one projection.

4. A spacer arrangement as claimed in claim 1, wherein grout is provided between adjacent surfaces of said manhole cover frame, said at least one spacer element and/or said cap.

* * * * *